US005780217A

United States Patent [19]

Friour et al.

[11] Patent Number: 5,780,217

[45] Date of Patent: Jul. 14, 1998

[54] SILVER HALIDE PHOTOGRAPHIC EMULSION HAVING REDUCED PRESSURE FOGGING

[75] Inventors: Gérard Amédé Friour; Christiane Marie Feumi-Jantou, both of Chalon-sur-Saone, France

[73] Assignee: Eastman Kodak Company, Rochester, N.Y.

[21] Appl. No.: 662,409

[22] Filed: Jun. 12, 1996

[30] Foreign Application Priority Data

Jun. 19, 1995 [FR] France ..... 95 07526

[51] Int. Cl.[6] ..... G03C 1/015; G03C 1/005; G03C 1/04

[52] U.S. Cl. ..... 430/567; 430/569; 430/631; 430/966

[58] Field of Search ..... 430/634, 631, 430/567, 569, 966

[56] References Cited

U.S. PATENT DOCUMENTS

| | | | |
|---|---|---|---|
| 3,121,060 | 2/1964 | Duane | 252/56 |
| 4,199,363 | 4/1980 | Chen | 430/512 |
| 5,015,566 | 5/1991 | Dappen et al. | 430/567 |
| 5,302,501 | 4/1994 | Tamura et al. | 430/537 |
| 5,380,642 | 1/1995 | Roberts et al. | 430/569 |

FOREIGN PATENT DOCUMENTS

| | | | |
|---|---|---|---|
| 0 358 187 | 3/1990 | European Pat. Off. | G03C 1/053 |
| 0 482 599 A1 | 4/1992 | European Pat. Off. | G03C 1/10 |
| 61-267753 | 11/1986 | Japan | G03C 1/02 |

*Primary Examiner*—Mark F. Huff
*Attorney, Agent, or Firm*—Carl O. Thomas

[57] ABSTRACT

The present invention relates to a silver halide photographic emulsion having improved sensitometric properties; in particular, the present invention relates to a silver halide photographic product comprising this emulsion.

The emulsion of the invention comprises tabular grains consisting mainly of silver bromide dispersed in a binder consisting of a hydrophilic colloid and a latex, the emulsion before coating having a pAg between 9.0 and 9.9.

The present invention in particular enables the pressure fog to be reduced.

17 Claims, 1 Drawing Sheet

SILVER HALIDE PHOTOGRAPHIC EMULSION HAVING REDUCED PRESSURE FOGGING

FIELD OF THE INVENTION

The present invention relates to a silver halide photographic emulsion having improved sensitometric properties; in particular the present invention relates to a silver halide photographic product having reduced pressure fog.

BACKGROUND

Photographic products are often sensitive to pressure resulting from the physical contact between the product and the equipment used during the manufacture, transport, exposure, development or projection of photographic products. This sensitivity to pressure manifests itself differently according to the silver halide composition and/or according to the form of the grains contained in the photographic product. The sensitivity to pressure can result in either a desensitization of the photographic product or the formation of pressure fog. For example, when a photographic product having tabular grains made up essentially of silver bromide is used, the sensitivity to pressure of such a product results in the formation of fog.

Various methods have attempted to remedy this problem of sensitivity to pressure, particularly concerning color photographic products, by increasing the protection of the silver halide grains, for example by increasing the thickness of the protective top coat or by adding to this top coat particles of colloidal silica. Another technique involves increasing the gelatin/silver ratio in the silver halide layer. With these methods the aim is to protect the silver halide grains more effectively, which necessarily involves a delay in the development of the grains and consequently a reduction in the speed of the grains.

The sensitivity to pressure can also be reduced by adding a polymer in the form of latex or plasticizers to the silver halide emulsion layer.

For example, the sensitivity to pressure can be reduced by a method which involves adding a polyalcohol to the photographic product. In the U.S. Pat. No. 3,121,060, the pressure fog is reduced by adding paraffin and an organic acid salt to the photographic product.

All the methods described above enabling the sensitivity to pressure to be effectively reduced nevertheless have drawbacks. For example, adding a plasticizer to a photographic product reduces the flexibility of the emulsion layer and makes this layer sticky. Increasing the gelatine/silver ratio delays the development of the silver halide grains, which poses problems in fast processing.

For several years, photographic products with silver halides consisting of tabular grains have been appearing. These grains have many advantages such as, for example, an improved speed/granularity relationship, increased definition, improved covering power and an ability to be processed using fast processes.

The silver halide tabular grains are, nevertheless, very sensitive to pressure, which increases as the grain size is increased. This can be explained by the geometry of the grains, which is not very compact.

The photographic industry is increasingly requiring high-performance photographic products to be developed, which can be used in fast photographic processes without any deterioration in the quality of the image.

The use of silver halide tabular grains gives photographic products of high sensitometric performance but whose sensitivity to pressure is difficult to control, which is not compatible with faste processes or with applications which necessitate a great deal of handling. Additionally, when these tabular grains are used in black and white products intended for medical radiography, the pressure fog which appears when these products are subjected to localized pressure can result in an incorrect diagnosis.

In U.S. Pat. No. 5,015,566, the sensitivity to pressure of a photographic product consisting of silver halide tabular grains was improved by using, as a binder for the silver halide grains, a hydrophilic colloid forming a single phase and a latex consisting of polymethacrylate with a glass transition temperature below 50° C.

In European patent application 482 599, the pressure fog is reduced by adding to a silver halide light-sensitive emulsion layer, consisting of tabular grains having a aspect ratio of at least 2, a special aryl compound.

SUMMARY OF THE INVENTION

This invention provides a novel photographic product comprising a silver halide emulsion consisting of tabular grains which enables pressure fog to be reduced substantially whilst keeping good sensitometric properties and which is compatible with fast-action processing. This requirement is even more important in the field of medical radiography.

This aim is achieved according to the invention by means of a radiation-sensitive silver halide photographic emulsion which comprises, dispersed in a binder consisting of a hydrophilic colloid and a latex, grains mainly consisting of silver bromide where at least 50% of the total number of grains are tabular grains, the emulsion being characterized in that the weight ratio between the hydrophilic colloid and the silver contained in the emulsion is between 1.3 and 3, the ratio by weight between the latex and the hydrophilic colloid is between 1/25 and 1/2, and the pAg of the emulsion before coating is between 9.0 and 9.9.

The present invention also relates to a photographic product comprising such an emulsion and a method for preparing this emulsion.

DESCRIPTION OF PREFERRED EMBODIMENTS

Figure 1:
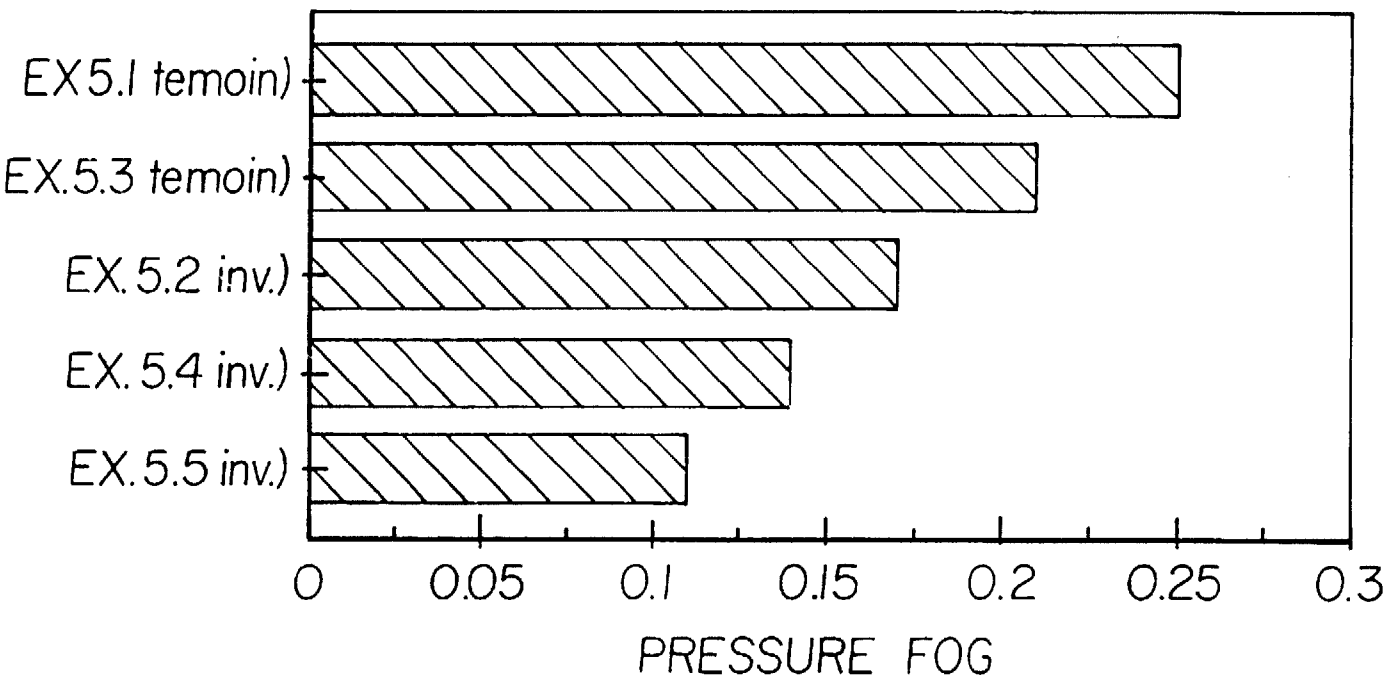
FIG. 1 shows the changes in pressure fog in the examples illustrating the present invention.

Within the scope of the present invention, the hydrophilic colloid is mainly gelatin and/or gelatin derivatives, for example gelatin treated with a base, gelatin treated with an acid, or modified gelatins such as acetylated gelatin or phthalylated gelatin. The gelatin and/or gelatin derivatives can be mixed with other natural hydrophilic colloids such as proteins, protein derivatives, cellulose derivatives such as cellulose esters, polysaccharides such as dextran, gum arabic, zein, casein, pectin, collagen derivatives, collodion, agar-agar, albumin, etc. References to these natural hydrophilic colloids can be found in *Research Disclosure*, September 1994, 507–36544, published by Kenneth Mason Publication Ltd, Hampshire PO10 7DQ, England and referred to in the remainder of the description as *Research Disclosure*.

According to a preferred embodiment of the invention, the natural hydrophilic colloid consists solely of gelatin and/or gelatin derivatives.

According to a preferred embodiment, the hydrophilic colloid/silver ratio by weight is between 1.5 and 2.0. The quantity of silver contained in an emulsion depends on the photographic product in which it is used. Generally, the quantity of silver is between 1 and 6 g/m$^2$. Within the scope of the present invention, the quantity of silver is preferably between 2 and 5 g/m$^2$.

The latexes are in the form of a discontinuous phase of solid polymer particles which are insoluble in water, in suspension in a continuous aqueous medium. The size of the polymer particles is generally between 0.02 and 0.2 μm.

Within the scope of the invention, the latex which is associated with the hydrophilic colloid to form the binder of the invention is preferably a vinyl polymer obtained from ethylenic non-saturation monomers of the formula:

$$(R^1)_2C{=}CR^1{-}CO{-}R^2$$

in which $R^1$ is a hydrogen atom, or an alkyl group with straight or branched chains of 1 to 10 carbon atoms, $R^2$ is selected from:

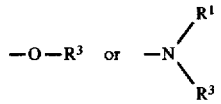

in which $R^3$ is selected from an alkyl group with a linear or branched chain having 1 to 10 carbon atoms, a cycloalkyl or aryl group having at least 5 atoms, where these groups may be substituted or not by alkoxy, aryloxy, alkylcarbonyl, arylcarbonyl, alcoxycarbonyl or aryloxycarbonyl groups or sulfo, carboxyl, phosphono, sulfato or sulphino groups.

These latexes are in particular alkyl or aryl polyacrylates, poly N-acrylates, or alkyl or aryl, polymethacrylates or poly N-methacrylates.

The $R^3$ group can, for example, be methyl, ethyl, propyl, isopropyl, butyl, amyl, hexyl, cyclohexyl, ethyl-2-hexyl, octyl, methoxy-2-ethyl, butoxy-2-ethyl, phenoxy-2-ethyl, cyanoethyl, benzyl, methoxybenzyl, furfuryl, phenyl, naphtyl, aceto-2-actoxyethyl, etc.

According to the invention, the latex can be a homopolymer or a copolymer obtained from ethylenic non-saturation monomers as defined above.

According to one embodiment, the latex is a polymer consisting of at least two of the following unsaturated ethylenic non-saturation monomers:

$$(R^1)_2C{=}CR^1{-}COOR^4 \quad (A)$$

$$(R^1)_2C{=}CR^1{-}COOR^5OCOR^5COR^4 \quad (B)$$

$$(R^1)_2C{=}CR^1{-}CONR^1R^5SO_3{}^{\ominus}X^{\oplus} \quad (C)$$

in which the $R^1$ groups, which may be identical or different, are as defined above, the $R^4$ groups, which may be identical or different, are alkyl groups of 1 to 4 carbon atoms, the $R^5$ groups, which may be identical or different, are alkylene groups with straight or branched chains of 1 to 10 carbon atoms, and X is the counter-ion associated with the sulfo group.

Preferably, the $R^1$ group is a hydrogen atom or an alkyl group comprising 1 to 4 carbon atoms and the $R^5$ group comprises 1 to 4 carbon atoms.

According to one embodiment, the latex is a terpolymer which has the following structure:

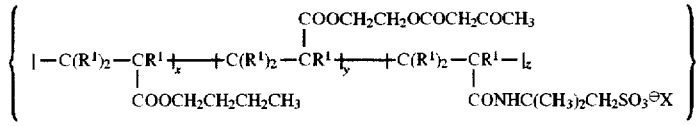

in which X is the counter-ion associated with the sulfo group chosen from amongst alkali metal ions or ammonium or alkylammonium ions, x represents between 10 and 95% and preferably at least 50% by weight of terpolymer, y represents between 3 and 50% and preferably between 2 and 20% by weight of terpolymer and z represents between 2 and 80% and preferably between 3 and 30% by weight of terpolymer, the sum of x, y and z being equal to 100%.

The preferred terpolymer is the terpolymer in which x is equal to 88%, y is equal to 7% and z is equal to 5%.

Within the scope of the invention, the ratio by weight between the latex and the hydrophilic colloid is preferably between 1/25 and 1/4.

The photographic emulsion of the present invention can be prepared using a method comprising the following steps:

(1) precipitation in a dispersion medium of silver halide tabular grains consisting mainly of silver bromide, (2) chemical sensitization of the emulsion, (3) addition of a latex, (4) addition of a hydrophilic colloid, and (5) adjustment of the pAg to between 9.0 and 9.9, the quantities of hydrophilic colloid and latex being such that the ratio between the hydrophilic colloid and the silver constituting the silver halide grains is between 1.3 and 3 and the ratio between the latex and the hydrophilic colloid is between 1/25 and 1/2.

The pAg of the emulsion is adjusted in a conventional fashion by adding halide salts such as potassium bromide, silver halides or organic compounds capable of combining with the silver such as mercaptotetrazole, mercaptotriazole, benzothiazole-2-thione, etc, or silver nitrate.

According to a preferred embodiment, the pAg of the emulsion before coating is adjusted to between 9.36 and 9.68.

The emulsion of the present invention can be spectrally sensitized. When this sensitization is necessary, the spectral sensitizing dye can be added before or after the chemical sensitizer or sensitizers. Within the scope of the invention, the spectral sensitizers are preferably added before the chemical sensitizers.

The method of the present invention can comprise other conventional steps in the precipitation of emulsions. Other compounds such as antifog agents, sequestering agents, plasticizers, etc can also be added.

Within the scope of the invention, "tabular grains" refers to silver halide grains where at least 50% of the total surface area is represented by faces (111).

According to the invention, the tabular grains have a mean thickness of less than 0.5 μm and preferably less than 0.2 μm, and a aspect ratio (R) greater than or equal to 2, and preferably between 2 and 30. According to a preferred embodiment, the aspect ratio of the tabular grains is between 10 and 30.

The aspect ratio (R) is the ratio of the equivalent circular diameter (ECD) to the mean thickness of the tabular grains (e).

Within the scope of the present invention, the silver halide tubular grains consist essentially of silver bromide, i.e. they contain at least 90% silver bromide. These grains can contain a quantity of iodide of less than 2%. However, according to a preferred embodiment, the grains are pure bromide. These grains are described for example in *Research Disclosure,* Section I.B.

The methods of precipitating these tabular grains are known and described for example in *Research Disclosure,* Section C.

The silver halide emulsions of the invention can contain doping agents, generally in small quantities, such as rhodium, indium, osmium, iridium ions etc. (See *Research Disclosure* Section I-D3). These doping agents are generally added during the precipitation of the emulsion.

The emulsions of the present invention can be polydisperse or monodisperse. According to an embodiment, monodisperse emulsions are used. The monodispersity of the emulsion is defined using the coefficient of variation (COV) which, expressed as a percentage, is equal to ($\sigma$/ECD).100, $\sigma$ being the standard deviation of the grain population and ECD being the equivalent circular diameter (in μm) of the tabular grains. The preferred monodisperse emulsions have a COV of less than 20% and preferably less than 10%. These monodisperse tabular grains can be prepared according to the method described in U.S. Pat. No. 5,210,013.

The silver halide emulsions can be chemically sensitized according to the methods described in *Research Disclosure,* Section IV. The chemical sensitizers generally used are compounds of sulfur and/or selenium and gold. Sensitization by reduction can also be used.

The spectral sensitization, or chromatization, methods are described in *Research Disclosure,* Section V. The sensitizing dyes can be added at various stages in the preparation of the emulsion, particularly before, during or after the chemical sensitization.

The silver halide emulsions can be spectrally sensitized with dyes from various categories, including polymethine dyes, which comprise cyanines, merocyanines, complex cyanines and merocyanines (namely tri-, tetra- and polynuclear cyanines and merocyanines), oxonols, semioxonols, styryls, merostyryls and streptocyanines. Representative spectral sensitizing dyes are described in *Research Disclosure,* Section V.

The photographic emulsions of the invention can contain, among others, optical brighteners, antifogging compounds, surfactants, plasticizers, lubricants, tanning agents, stabilizing agents and absorption and/or diffusion agents as described in *Research Disclosure* Sections II-B, VI, VII, VIII and IX.

The photographic product of the invention comprises a support having coated on at least one of its faces the emulsion of the present invention. These products can contain other conventional layers in the photographic products such as protective layers (top coating), spacing layers, filter layers and anti-halo layers. The support can be any suitable support used for photographic products. Conventional supports comprise polymer films, paper (including polymer-coated paper), glass and metal. *Research Disclosure* Section XV provides details on supports and ancillary layers for photographic products.

The photographic products of the invention can be hardened by means of hardening agents as described in *Research Disclosure* Section II.B. Within the scope of the invention, the emulsions consisting of tabular grains with a high aspect ratio can be hardened to a significant degree without any deterioration in their covering power being observed.

The emulsions of the present invention can be used in a large number of photographic products, for example black and white films, color films, positive films or negative films, medical or industrial radiography films, films for graphic arts, etc.

The present invention is illustrated by the following examples.

EXAMPLES

In the examples, the photographic products used are intended for medical radiography.

These products consist of an Estar® support having coated on each side a layer of silver halide emulsion consisting of pure bromide tabular grains (silver content 2.1 g/m$^2$). The silver bromide tabular grains represent more than 90% of the total number of grains constituting the emulsion.

These emulsions are monodisperse (COV less than 10%). They were prepared in accordance with the precipitation method described in U.S. Pat. No. 5,210,013.

After the precipitation of the silver halide emulsion in a dispersion medium, the tabular grains are washed. After washing, each of the emulsions described below is spectrally sensitized to the optimum by means of a mixture of spectral sensitizers of structures (1) and (2) in a quantity between 200 and 600 mg/mol Ag (ratio by weight (1)/(2)=1.4), at a temperature of 40° C.

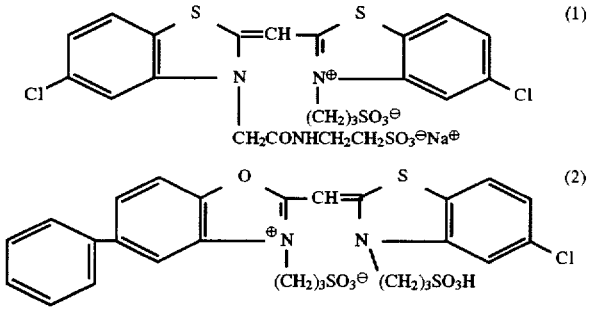

After having kept the emulsion spectrally sensitized for 20 min at 40° C., the chemical sensitizers are added at a temperature of 40° C. over 10 min. The emulsion is chemically sensitized to the optimum by means of sulfur and gold, the quantity of sulfur being between 15,000 and 25,000 At/μm$^2$ and the quantity of gold between 7,500 and 12,500 At/μm$^2$.

Latex, in the form of a 20% suspension in deionized water, and then gelatin, are added to this sensitized emulsion. Then an antifogging agent (1 to 3 g/mol Ag of tetraazaindene) and a plasticizer (1 to 5 g/mol Ag of glycerol) are added.

The pH of the emulsion is then adjusted to 6.5 by adding soda (100 g/l), and then the pAg of the emulsion is adjusted by adding potassium bromide (44 g/l). Thus, the value of the pAg before coating is obtained.

This light-sensitive emulsion is coated on each side of a support. A protective layer consisting of gelatin is coated on each emulsion layer. The product is hardened with a quantity of bis(vinylsulfonylmethyl) ether, the content by weight of the tanning agent being equal to 2.25% of the total dry gelatin contained in the product.

The latex which is added to the photographic products in the following examples has the following formula:

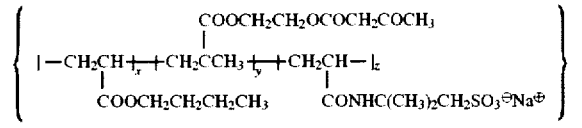

in which x represents 88% by weight of polymer, y represents 7% by weight of polymer and z represents 5% by weight of polymer.

The photographic products of the invention thus obtained are exposed in the blue wavelengths through a W39™ filter to the light from a tungsten lamp (2850° K) for 0.02 s. They are then processed using RP X-OMAT MX 810™ for 90 seconds at 35° C.

The sensitivity of the photographic products is measured for a density equal to 1.

The pressure fog is measured in the following manner:

The product is subject to a pressure of 172 kPa by means of a smooth roller. The product is then exposed and treated as previously described. The pressure fog corresponds to the increase in density in the clearest (non exposed) areas of the product after the pressure has been applied.

Example 1

(Control): Variation in the Gelatin/Silver Ratio

In this example, a pure bromide emulsion with tabular grains with a aspect ratio of 18 (ECD=2.95 μm; e=0.16) is used, chemically and spectrally sensitized as previously described (Em 1).

Then the following samples are prepared in the format described above:

| | | |
|---|---|---|
| Em 1.1: | Gelatin/silver ratio | 1.36 |
| | pAg before coating | 9.02 |
| | Quantity of latex | 0% |
| Em 1.2: | Gelatin/silver ratio | 1.6 |
| | pAg before coating | 9.02 |
| | Quantity of latex | 0% |
| Em 1.3: | Gelatin/silver ratio | 1.9 |
| | pAg before coating | 9.02 |
| | Quantity of latex | 0% |

The samples are exposed, developed and tested according to the method described above. The sensitometric results are recorded in Table 1 below.

TABLE 1

| Sample | Sens. | Pressure fog |
|---|---|---|
| Em 1.1 | 100 | 0.26 |
| EM 1.2 | 97 | 0.18 |
| Em 1.3 | 94 | 0.12 |

The sensitometric results obtained show that the increase in the gelatin/silver ratio affords a reduction in the level of pressure fog. However, a decrease in the sensitivity is observed when the Gel/Ag ratio is increased.

Example 2

Variation in the pAg of the Emulsion Before Coating

In this example a pure bromide emulsion with tabular grains with a shape factor of 28, (ECD=3.39 μm; e=0.12) is used, chemically and spectrally sensitized as previously described in (Em 2).

From this emulsion, the following samples are prepared in the format described above:

| | | |
|---|---|---|
| Em 2.1: | Gelatin/silver ratio | 1.52 |
| | pAg before coating | 9.02 |
| | Quantity of latex | 0% |
| Em 2.2: | Gelatin/silver ratio | 1.52 |
| | pAg before coating | 9.68 |
| | Quantity of latex | 0% |

The samples are exposed, developed and tested according to the method described above.

The sensitometric results recorded in Table 2 show that, when the pAg of the emulsion is increased before coating, the reduction in the pressure fog is accompanied by a reduction in the sensitivity of the emulsion.

TABLE 2

| Sample | Sens. | Pressure fog |
|---|---|---|
| Em 2.1 | 100 | 0.32 |
| Em 2.2 | 94 | 0.23 |

Example 3

Addition of Latex

In this example, a pure bromide emulsion with tabular grains with a aspect ratio of 29 (ECD—3.5 μm; e=0.12) is used, chemically and spectrally sensitized as previously described (Em 3).

From this emulsion, the following samples are prepared according to the format described above:

| | | |
|---|---|---|
| Em 3.1: | Gelatin/silver ratio | 1.52 |
| | pAg before coating | 9.02 |
| | Quantity of latex | 0% |
| Em 3.2: | Gelatin/silver ratio | 1.2 |
| | pAg before coating | 9.02 |
| | Quantity of latex (latex/gel) | 20% (¼) |
| Em 3.3: | Gelatin/silver ratio | 1.52 |
| | pAg before coating | 9.02 |
| | Quantity of latex (latex/gel) | 20% (♦) |
| Em 3.4: | Gelatin/silver | 1.52 |
| | pAg before coating | 9.02 |
| | Quantity of latex (latex/gel) | 20% (¼) |

(♦ added to the top coating)

In sample 3.2, the Gel/Ag ratio is equal to 1.2 and the ratio of the total quantity of binder (gelatin and latex) to the quantity of silver contained in the photographic product is equal to 1.52 as in sample 3.1.

The samples are exposed, developed and assessed according to the method described above. The sensitometric results are recorded in the table below.

TABLE 3

| Sample | Sens. | Pressure fog |
|---|---|---|
| Em 3.1 | 100 | 0.2 |
| Em 3.2 | 108 | 0.25 |
| Em 3.3 | 102 | 0.22 |
| Em 3.4 (INV) | 102 | 0.15 |

These results show that the pressure fog is not reduced when the latex is added either to the top coat of the photographic product, or to a photosensitive layer having a gelatin/silver ratio of 1.2. It is also clear that adding latex does not reduce the sensitivity.

Example 4

In this example, a pure bromide emulsion with tabular grains with a aspect ratio of 29 (ECD—3.9 μm; e=0.13) is used, chemically and spectrally sensitized as previously described (Em 4).

From this emulsion, the following samples are prepared according to the format described above:

| | | |
|---|---|---|
| Em 4.1: | Gelatin/silver ratio | 1.3 |
| | pAg before coating | 9.02 |
| | Quantity of latex | |
| Em 4.2: | Gelatin/silver ratio | 1.3 |
| | pAg before coating | 9.02 |
| | Quantity of latex (latex/gel) | 10% (1/9) |
| Em 4.3: | Gelatin/silver ratio | 1.3 |
| | pAg before coating | 9.02 |
| | Quantity of latex (latex/gel) | 20% (1/4) |
| Em 4.4: | Gelatin/silver | 1.6 |
| | pAg before coating | 9.02 |
| | Quantity of latex (latex/gel) | 20% (1/4) |
| Em 4.5: | Gelatin/silver | 1.6 |
| | pAg before coating | 9.68 |
| | Quantity of latex (latex/gel) | 20% (1/4) |
| Em 4.6: | Gelatin/silver | 1.9 |
| | pAg before coating | 9.68 |
| | Quantity of latex (latex/gel) | 20% (1/4) |
| Em 4.7: | Gelatin/silver | 2.5 |
| | pAg before coating | 9.68 |
| | Quantity of latex (latex/gel) | 20% (1/4) |

The samples are exposed, developed and tested according to the method described above. The sensitometric results are recorded in the table below.

TABLE 4

| Sample | Sens. | Pressure fog |
|---|---|---|
| Em 4.1 (control) | 190 | 0.44 |
| Em 4.2 (inv) | 101 | 0.35 |
| Em 4.3 (inv) | 102 | 0.27 |
| Em 4.4 (inv) | 92 | 0.2 |
| Em 4.5 (inv) | 94 | 0.1 |
| Em 4.6 (inv) | 91 | 0.06 |
| Em 4.7 (inv) | 87 | 0.05 |

Samples 4.1, 4.2 and 4.3 show that for a Gel/Ag ratio of approximately 1.3 and a pAg before coating of 9.02, the fog level is greatly improved by adding latex to the photosensitive layer (approximately 40% reduction in pressure fog).

Samples 4.4 and 4.5 show that the pressure fog is further reduced when the pAg of the emulsion is increased before coating, the Gel/Ag ratio and the quantity of latex being constant (approximately 80% reduction in pressure fog).

Samples 4.6 and 4.7 show that, when the Gel/Ag ratio is increased, the pressure fog is greatly improved (approximately 90% reduction in pressure fog). Although a slight reduction in sensitivity is observed when the Gel/Ag ratio is increased, a good compromise is reached within the scope of the present invention, with a very low level of fog.

Example 5

In this example, a pure bromide emulsion with tabular grains with a shape factor of 27 (ECD—4.4 μm; e=0.16) is used, chemically and spectrally sensitized as previously described (Em 5).

From this emulsion, the samples are prepared according to the format described above:

| | | |
|---|---|---|
| Em 5.1: | Gelatin/silver ratio | 1.52 |
| | pAg before coating | 9.02 |
| | Quantity of latex | 0% |
| Em 5.2: | Gelatin/silver ratio | 1.52 |
| | pAg before coating | 9.02 |
| | Quantity of latex (latex/gel) | 20% (1/4) |
| Em 5.3: | Gelatin/silver ratio | 1.71 |
| | pAg before coating | 9.02 |
| | Quantity of latex | 0% |
| Em 5.4: | Gelatin/silver ratio | 1.71 |
| | pAg before coating | 9.02 |
| | Quantity of latex (latex/gel) | 20% (1/4) |
| Em 5.5: | Gelatin/silver ratio | 1.71 |
| | pAg before coating | 9.68 |
| | Quantity of latex (latex/gel) | 20% (1/4) |

The samples are exposed, developed and assessed according to the method described above. The sensitometric results are recorded in the table below.

TABLE 5

| Sample | Sens. | Pressure fog |
|---|---|---|
| Em 5.1 (control) | 100 | 0.25 |
| Em 5.2 (inv) | 103 | 0.17 |
| Em 5.3 (control) | 99 | 0.21 |
| Em 5.4 (inv) | 102 | 0.14 |
| Em 5.5 (inv) | 100 | 0.11 |

FIG. 1 shows the reduction in the pressure fog in the samples in Example 5. It should be noted that the emulsion used in this example consists of broad tabular grains (ECD= 4.4 μm), which should make it much more sensitive to pressure.

According to the results obtained, it seems clear that the pressure fog is greatly reduced when the combination of the present invention is used (a reduction of more than 50%) without a deterioration in sensitivity being observed.

Example 6

In this example the pure bromide emulsion of Example 2 is used (Em 2).

From this emulsion, the sample is prepared according to the format described above:

| | | |
|---|---|---|
| Em 6.1: | Gelatin/silver ratio | 1.71 |
| | pAg before coating | 9.68 |
| | Qualtity of latex (latex/gel) | 4% (1/20) |

A first sample is exposed, developed and assessed as in the previous examples (RP-X-OMT® processing).

A second sample is exposed according to the method described above but this sample is developed with a KODAK RA/30® fast-action (45 sec) processing. The pressure fog is measured for each sample.

The following results are obtained, which show that the product of the present invention can be processed with a fast-action development while maintaining comparable pressure fog.

TABLE 6

| | Pressure fog (RP X-OMAT ®, 90 sec) | Pressure fog (RA/30 ®, 45 sec) |
|---|---|---|
| Em 6.1 | 0.1 | 0.091 |

The invention has been described in detail with particular reference to certain preferred embodiments thereof, but it will be understood that variations and modifications can be effected within the spirit and scope of the invention.

We claim:

1. Radiation-sensitive silver halide photographic emulsion which comprises, dispersed in a binder consisting of a hydrophilic colloid and a latex, grains comprised of silver bromide where at least 50% of the total number of grains are tabular grains, the emulsion being characterized in that (1) the ratio by weight between the hydrophilic colloid and the silver contained in the emulsion is between 1.3 and 3, (2) the ratio by weight between the latex and the hydrophilic colloid is between 1/25 and 1/2, and (3) the pAg of the emulsion before coating is between 9.0 and 9.9, the latex being a vinyl polymer obtained from monomers of the formula:

$$(R^1)_2C{=}CR^1{-}CO{-}R^2$$

in which $R^1$ is a hydrogen atom, or an alkyl group with straight or branched chains of 1 to 10 carbon atoms, $R^2$ is selected from:

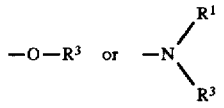

in which $R^3$ is selected from an alkyl group with a linear or branched chain having 1 to 10 carbon atoms, a cycloalkyl or aryl group having at least 5 atoms, where these groups may be substituted or not by alkoxy, aryloxy, alkylcarbonyl, arylcarbonyl, alcoxycarbonyl or aryloxycarbonyl groups or sulpho, carboxyl, phosphono, sulphato or sulphino groups.

2. Photographic emulsion according to claim 1, in which the pAg of this emulsion before coating is between 9.36 and 9.68.

3. Photographic emulsion according to claim 1, in which the hydrophilic colloid/silver ratio is between 1.5 and 2.

4. Photographic emulsion according to claim 1, in which the ratio between the latex and the hydrophilic colloid is between 1/25 and 1/4.

5. Photographic emulsion according to claim 1, in which the hydrophilic colloid is gelatin or one of its derivatives.

6. Photographic emulsion according to claim 1 in which the latex consists of at least two of the following monomers:

$$(R^1)_2C{=}CR^1{-}COOR^4 \quad (A)$$

$$(R^1)_2C{=}CR^1{-}COOR^5OCOR^5COR^4 \quad (B)$$

$$(R^1)_2C{=}CR^1{-}CONR^1R^5SO_3^{\ominus}X^{\oplus} \quad (C)$$

in which the $R^1$ groups, which may be identical or different, are as defined above, the $R^4$ groups, which may be identical or different, are alkyl groups of 1 to 4 carbon atoms, the $R^5$ groups, which may be identical or different, are alkylene groups with straight or branched chains of 1 to 10 carbon atoms, and X is the counter-ion associated with the sulfo group.

7. Photographic emulsion according to claim 6, in which the $R^1$ group is a hydrogen atom or an alkyl group comprising 1 to 4 carbon atoms and the $R^5$ group comprises 1 to 4 carbon atoms.

8. Photographic emulsion according to claim 6, in which the latex is the terpolymer of the formula:

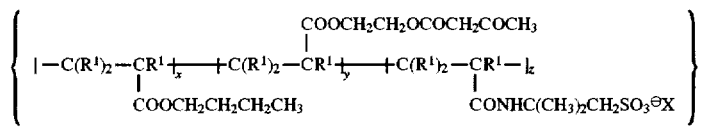

in which X is the counter-ion associated with the sulpho group chosen from alkali metal ions or ammonium or alkylammonium ions, x represents between 10 and 95% by weight of terpolymer, y represents between 3 and 50% by weight of terpolymer and z represents between 2 and 80% by weight of terpolymer, the sum of x, y and z being equal to 100%.

9. Photographic emulsion according to claim 8 wherein x represents at least 50% by weight of terpolymer.

10. Photographic emulsion according to claim 8 wherein y represents between 2 and 20% by weight of terpolymer.

11. Photographic emulsion according to claim 8 wherein z represents between 3 and 30% by weight of terpolymer.

12. Photographic emulsion according to claim 1, in which the tabular grains have an aspect ratio greater than or equal to 2.

13. Photographic emulsion according to claim 1, in which the emulsion contains silver bromoiodide grains containing a quantity of iodide below 2%.

14. Photographic emulsion according to claim 1, in which the emulsion contains pure bromide emulsion grains.

15. Radiographic product comprising a support covered on at least one of its faces by a layer of silver halide emulsion as defined according of any one of claims 1–5 or 7–14.

16. Radiographic product according to claim 15, in which the layer or layers of silver halide emulsion are covered with a protective layer.

17. Method for preparing a silver halide emulsion comprising the following steps:

(1) precipitation in a dispersion medium of tabular silver halide grains comprised of tabular silver bromide, (2) chemical sensitization of the emulsion, (3) addition of a latex, (4) addition of a hydrophilic colloid, and (5) adjustment of the pAg to between 9.0 and 9.9, the quantities of hydrophilic colloid and latex being such that the ratio between the hydrophilic colloid and the silver is between 1.3 and 3 and the ratio between the latex and the hydrophilic colloid is between 1/25 and 1/2, the latex being a vinyl polymer obtained from monomers of the formula:

$$(R^1)_2C{=}CR^1{-}CO{-}R^2$$

in which $R^1$ is a hydrogen atom, or an alkyl group with straight or branched chains of 1 to 10 carbon atoms, $R^2$ is selected from:

$$-O-R^3 \quad \text{or} \quad -N\begin{matrix} R^1 \\ R^3 \end{matrix}$$

in which $R^3$ is selected from an alkyl group with a linear or branched chain having 1 to 10 carbon atoms, a cycloalkyl or aryl group having at least 5 atoms, where these groups may be substituted or not by alkoxy, aryloxy, alkylcarbonyl, arylcarbonyl, alcoxycarbonyl or aryloxycarbonyl groups or sulpho, carboxyl, phosphono, sulphato or sulphino groups.

* * * * *